United States Patent [19]

Korda

[11] Patent Number: 4,824,060

[45] Date of Patent: Apr. 25, 1989

[54] PAINT CAN HOLDER FOR HOLLOW RUNG LADDERS

[76] Inventor: Edward S. Korda, 244 Moorgate St., Winnipeg, Manitoba, Canada, R3J 2L2

[21] Appl. No.: 171,965

[22] Filed: Mar. 23, 1988

[30] Foreign Application Priority Data

Apr. 7, 1987 [CA] Canada ..... 534098

[51] Int. Cl.[4] ..... E06C 7/14

[52] U.S. Cl. ..... 248/210; 182/129; 248/113

[58] Field of Search ..... 248/210, 211, 238, 311.2, 248/310, 113; 182/129

[56] References Cited

U.S. PATENT DOCUMENTS

| | | | |
|---|---|---|---|
| 1,313,803 | 8/1919 | Dunn . | |
| 2,560,228 | 7/1951 | Kosorok | 248/113 X |
| 2,747,825 | 5/1956 | Lachenmayer | 248/310 X |
| 2,990,152 | 6/1961 | Whitney | 248/210 |
| 3,160,383 | 12/1964 | Lamm . | |
| 3,223,369 | 12/1965 | Benninger . | |
| 3,980,264 | 9/1976 | Tomasik | 248/210 |
| 4,099,693 | 7/1978 | Blann . | |
| 4,253,733 | 6/1985 | Lunden . | |
| 4,433,822 | 2/1984 | Caggiano | 248/210 |
| 4,445,659 | 5/1984 | La Chance | 248/210 |
| 4,489,911 | 12/1984 | Riley | 182/129 X |
| 4,560,127 | 12/1985 | Ippolito | 248/210 |
| 4,577,820 | 3/1986 | Michaud . | |
| 4,702,446 | 10/1987 | Brown | 248/210 |

FOREIGN PATENT DOCUMENTS

| | | | |
|---|---|---|---|
| 0683720 | 12/1952 | United Kingdom | 248/210 |

*Primary Examiner*—Ramon O. Ramirez
*Attorney, Agent, or Firm*—Irell & Manella

[57] ABSTRACT

Paint cans are usually supported by a wire hook over the rung of a ladder and either lie against one end of one of the side rails or depend from a rung on the rear side of a ladder leaning against a structure being painted. The present device includes a quickly detachable rod or shaft engaging through the hollow rung of an aluminum ladder and having a paint can supporting cradle on one end thereof in which the paint can is supported vertically in a convenient position relative to the ladder.

16 Claims, 2 Drawing Sheets

PAINT CAN HOLDER FOR HOLLOW RUNG LADDERS

BACKGROUND OF THE INVENTION

This invention relates to new and useful improvements in supports for containers and the like, from a ladder and although it is designed specifically for use with containers of paint or stain, nevertheless it can be used to support other containers if desired.

It is also designed specifically for use with a ladder having hollow rungs, usually, but not always, manufactured from aluminum and which, in the case of an extension ladder, includes an outer and inner section having rungs of slightly different lengths.

Conventionally, a painter fashions an "S" hook which engages over a convenient rung with the bail of the paint can engaging the other end of the hook and either leaning at an angle against one side rail of the ladder or, alternatively, depending vertically downwardly from a rung behind the ladder which is usually leaning against the structure being painted.

In the first instance, the paint can tends to roll around the sloping side rail making access difficult and often resulting in paint, stain or the like dripping to the ground or being deposited upon the side rail.

In the second instance, the operator has to either extend the brush between adjacent rungs in order to engage same with the paint can or, alternatively, extend the brush around one of the side rails in order to engage the paint can with the results being similar to that hereinabove described.

PRIOR ART

Patents known to applicant comprise the following:

U.S. Pat. No. 4,577,820 Mar. 25, 1986 J. J. Machaud. This shows a bar insertable within a hollow rung with a hook on one end which together with braces, supports the paint can outboard of the ladder.

U.S. Pat. No. 4,099,693 July 11, 1978 E. L. Blann. This shows a support extending through a hollow rung at an angle and having a hook and brace upon the distal end thereof to support a paint can outboard of the ladder.

U.S. Pat. No. 3,160,383 Dec. 8, 1964 C. R. Lamm. This shows a bar extending through a rung in a horizontal manner with a stopper on one end and a hook and brace arrangement on the other to support a paint can outboard of the ladder.

U.S. Pat. No. 3,223,369 Dec. 14, 1965 J. A. Benninger Jr. This shows a bar insertable within one end of a hollow rung of a ladder and having a slanted groove formed around the distal end engagable by the bale of a paint can outboard of the ladder.

U.S. Pat. No. 1,313,803 Aug. 19, 1919 J. A. Dunn. This shows a ring holding a tapered container offset from a ladder and clamped to the vertical side portion of the ladder.

U.S. Pat. No. 4,523,733 June 18, 1985 C. K. Lunden Jr. This shows a bar extending through a hollow rung with a support cradle depending therefrom adapted to hold a square container.

The present invention overcomes these disadvantages by providing a detachable supporting device for a container which is supported through one of the hollow rungs of the ladder and detachably clamped thereat with a container support extending off to one side of one of the side rails a predetermined amount and being adjustable so that the container supported thereby may be positioned vertically regardless of the slope of the ladder when leaned against a structure.

In accordance with the invention there is provided a container holder for paint cans and the like for use with ladders having hollow rungs comprising in combination a ladder rung engaging shaft, means on one end of said shaft to detachably retain same in the ladder rung, means on the other end of said shaft to detachably clamp same into the ladder rung and further means on said other end of said shaft to detachably retain and support a container offstanding from said other end of said shaft and clear of the associated ladder.

Another advantage of the invention is to provide means whereby the device is suitable for use with hollow rungs of ladders of differing internal diameters.

Still another object of the invention is to provide a device which is easily attached and detached from a ladder rung.

A still further advantage of the invention is to provide means to detachably hold a brush either clear of the paint can or over the open end thereof and, if desired, with the bristles of the brush engaging the paint in order to maintain the brush in a soft condition for relatively limited periods.

A yet further advantage of the invention is to provide a device which is simple in construction, economical in manufacture and well suited for the use with all hollow rung type ladders.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

Figure 1:
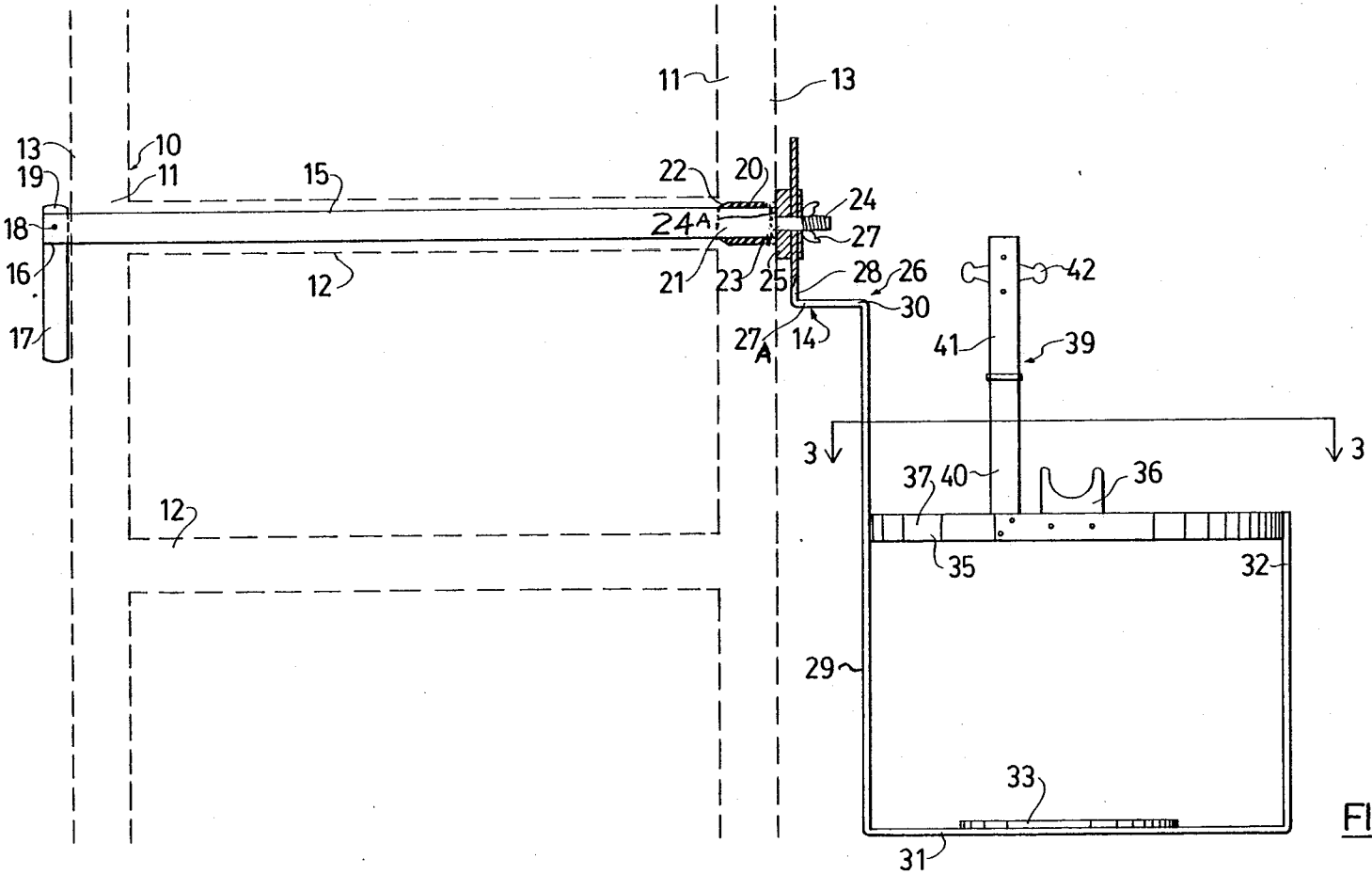
FIG. 1 is a front elevation of the assembly shown upon a hollow rung ladder illustrated in phantom.

Proceeding therefore to describe the invention in detail, reference should first be made to FIG. 1 in which reference character 10 collectively indicates a portion of a ladder shown in phantom which includes a pair of spaced and parallel side rails 11 and a plurality of hollow rungs 12 extending substantially horizontally therebetween as is conventional, it being understood that these rungs usually extend clear through the side walls and are open ended on the outer surfaces 13 thereof.

The invention collectively designated 14 includes a shaft 15 having a diameter less than the internal diameter of the rung 12 and adapted to extend clear through the rung 12 with one end 16 extending beyond the outer surface 13 of one of the side rails.

A swing latch plate 17 consists of a relatively short, flat plate pivoted between the bifurcated end 16 of the shaft 12, by means of a pivot pin 18 so that if the shaft is extended through the rung with the latch plate lying axially with the shaft, the latch plate will swing by gravity to the vertical position shown in FIG. 1 when extended through one end of the rung, thus detachably retaining the shaft within the rung from the end 16 thereof, it being noted that the pivot 18 is substantially towards one end 19 of the latch plate 17.

A rubber sleeve 20 is engageable over the other end 21 of the shaft 15 which extends through the other end of the rung and is provided with a tapered inner end 22 for ease of engagement within the hollow rung 12 and the thickness of the wall of this resilient sleeve is chosen so that it will fit snugly over the shaft and also within the end 20 thus holding the shaft substantially parallel with the longitudinal axis of the rung and preventing any tipping or tilting of the shaft from occurring.

A spindle 23 extends axially from this other end 21 of the shaft and is screwthreaded at the end thereof as indicated at 24 thus defining a shoulder 24A with the shaft, on said other end, and a relatively thick spacer washer 25 engages over the spindle and against the outer surface 13 of the side member of the ladder with a container support assembly collectively designated 26 also engaging over the spindle 23 and being clamped in position against the spacer 25 by means of a screwthreaded wing nut 27 engaging the screwthreaded end 24 of the spindle.

Tightening the wing nut clamps the container support assembly 26 in position against the shoulder 24A so that it can be used on rungs of both inner and outer sections of an extension ladder, the rungs of which are of slightly different lengths.

The assembly 26 includes a strap 27A having a substantially vertical shaft engaging portion 28, and a lower substantially vertical portion 29 stepped inwardly from the portion 28 by means of the angulated portion 30.

A base strap portion 31 extends at right angles from the lower end of the base portion of the strap 29 and an outer upwardly extending portion 32 extends upwardly from the outer end of the base portion 31 making a substantially u-shaped bracket as clearly shown in the drawings.

Figure 2:
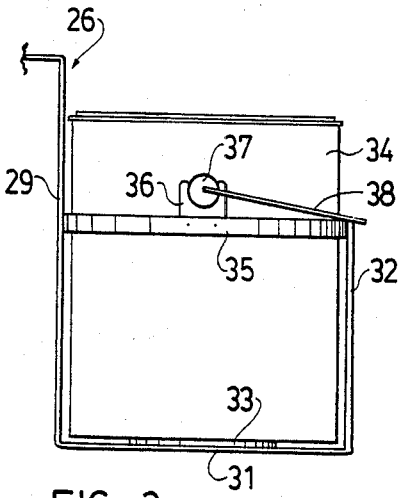
FIG. 2 is a fragmentary front elevation of the container support means with a container shown therein.
Figure 3:
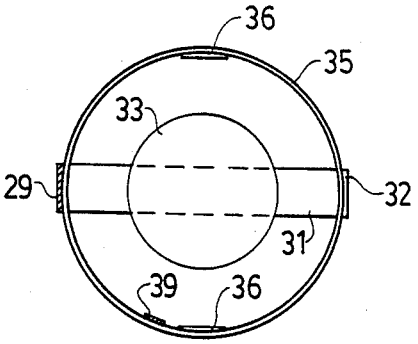
FIG. 3 is a cross sectional view substantially along the line 3—3 of FIG. 1.

A plate 33 is secured to the base portion 31 on the upper side thereof and acts as a support for the container shown as a paint or stain can 34 in FIG. 2. A cylindrical strap 35 is secured between the vertical portions 29 and 32 of the strap adjacent the upper end of the portion 32 and this surrounds the container 34 when the container is placed into the cradle formed by this portion of the strap assembly 26.

A pair of u-shaped brackets 36 extend upwardly from the upper edge 37 of the cylindrical ring 35 and are diametrically opposite to one another and these receive the side bosses 37 of a conventional paint can from which the bail 38 extends. The ring prevents sideways movement of the paint can or container 34 and the brackets 36 prevent rotational movement within the cradle.

It will also be appreciated that prior to tightening wing nut 27, and with the ladder leaning against the structure to be painted, the bracket assembly 26 may be allowed to swing vertically by gravity at which time the wing nut 27 may be tightened to prevent any further swinging movement of the assembly 26.

Figure 5:
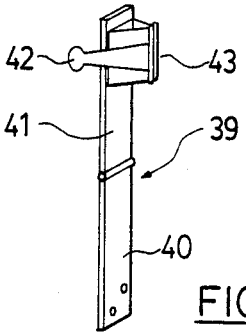
FIG. 5 is an isometric view of the brush holder portion per se.
Figure 4:
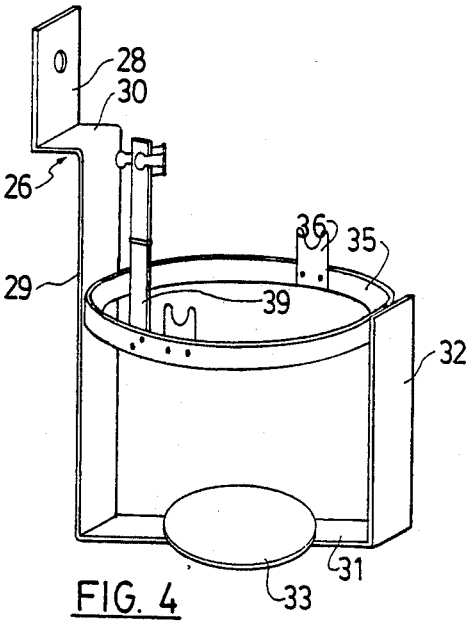
FIG. 4 is an isometric view of the container support component per se.
Figure 6:
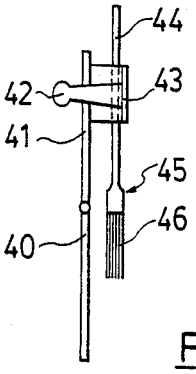
FIG. 6 is a side elevation of FIG. 5. In the drawings like characters of reference indicate corresponding parts in the different figures.

A brush holding bracket 39 includes a base portion 40 which is secured to the cylindrical ring 35 and extends upwardly therefrom with a major portion 41 being hingedly secured to the upper end of portion 40 as clearly shown in FIGS. 5 and 6.

A clamp taking the form of a spring clip 42 is secured adjacent the upper end of the portion 41 with the jaws 43 being adapted to engage around the handle 44 of a paint brush 45 which may depend therefrom with the hinge being selectively movable from a vertical position in which the brush bristles 46 are suspended above the open end of the container (or may be lowered into the contents thereof), and may be swung horizontally so that the brush is held clear of the paint can depending upon the desires of the operator.

The assembly is easily attached and detached from the relevant hollow rung of a ladder and the configuration of the strap assembly 26 is such that, in conjunction with the space at 25, it is held well clear of the outer surface 13 of the side member 11 of the ladder.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A holder for paint cans and the like for use with ladders having hollow rungs comprising in combination a ladder rung engaging shaft, means on one end of said shaft to detachably retain same in the ladder rung, means on the other end of said shaft to detachably clamp same into the ladder rung and further means on said other end of said shaft to detachably retain and support a container offstanding from said other end of said shaft and clear of the associated ladder, said means to retain said shaft in the ladder rung including a swing latch plate pivoted adjacent one end thereof to said shaft and normally swinging by gravity to a substantially retaining position perpendicular to the axis of said shaft.

2. The holder according to claim 1 in which said means on said other end of said shaft includes a resilient sleeve engaging over said other end and engaging within one end of the associated hollow rung of the ladder.

3. The holder according to claim 2 in which said means on said other end of said shaft also includes a screwthreaded spindle extending axially from said other end of said shaft and defining a shoulder with said other end, a spacer washer on said spindle and engaging against said shoulder and nut means screwthreadably engaging said spindle.

4. The holder according to claim 1 in which said further means on said other end of said shaft to detachably detain and support a container includes strap means detachably secured to said other end of said shaft, said strap means including a substantially vertical other end engaging portion, a container base supporting member and a container wall retaining member spaced above said base supporting member, said members extending substantially at right angles from said other end engaging portion of said strap.

5. The holder according to claim 2 in which said further means on said other end of said shaft to detachably detain and support a container includes strap means detachably secured, to said other end of said shaft, said strap means including a substantially vertical other end engaging portion, a container base supporting member and a container wall retaining member spaced above said base supporting member, said members extending substantially at right angles from said other end engaging portion of said strap.

6. The holder according to claim 3 n which said further means on said other end of said shaft to detachably detain and support a container includes strap means detachably secured to said other end of said shaft, said strap means including a substantially vertical other end engaging portion, a container base supporting member and a container wall retaining member spaced above said base supporting member, said members extending substantially at right angles from said other end engaging portion of said strap.

7. The holder according to claim 4 in which said strap means includes a base portion extending perpendicularly from said other end engaging portion, a distal end portion extending upwardly from the outer end of said base portion in spaced and parallel relationship to said other end engaging portion, an container base support plate on said base portion, said container wall retaining member comprising a cylindrical ring and a pair of container boss-engaging brackets on the upper side of said ring diametrically opposite to one another.

8. The holder according to claim 5 in which said strap means includes a base portion extending perpendicularly from said other end engaging portion, a distal end portion extending upwardly from the outer end of said base portion in spaced and parallel relationship to said shaft engaging portion, a container base support plate on said base portion, said container wall retaining member comprising a cylindrical ring and a pair of container boss-engaging brackets on the upper side of said ring diametrically opposite to one another.

9. The holder according to claim 6 in which said strap means includes a base portion extending perpendicularly from said other end engaging portion, a distal end portion extending upwardly from the outer end of said base, portion in spaced and parallel relationship to said other end engaging portion, a container base support plate on said base portion, said container wall retaining member comprising a cylindrical ring and a pair of container boss-engaging brackets on the upper side of said ring diametrically opposite to one another.

10. The holder according to claim 1, which includes hinged support means for detachably receiving an associated paint brush, said support means being secured to and extending upwardly from said further means on said other end of said shaft.

11. The holder according to claim 3, which includes hinged support means for detachably receiving an associated paint brush, said support means being secured to and extending upwardly from said further means on said other end of said shaft.

12. The holder according to claim 4, which includes hinged support means for detachably receiving an associated paint brush, said support means being secured to and extending upwardly from said container wall retaining means on said other end of said shaft.

13. The holder according to claim 5, which includes hinged support means for detachably receiving an associated paint brush, said support means being secured to and extending upwardly from said container wall retaining means on said other end of said shaft.

14. The holder according to claim 6, which includes a hinged bracket extending upwardly from a cylindrical ring and clamp means on said bracket for detachably receiving and supporting an associated paint brush therein.

15. The holder according to claim 7, which includes a hinged bracket extending upwardly from a cylindrical ring and clamp means on said bracket for detachably receiving and supporting an associated paint brush therein.

16. The holder according to claim 9, which includes a hinged bracket extending upwardly from a cylindrical ring and clamp means on said bracket for detachably receiving and supporting an associated paint brush therein.

* * * * *